US006834170B2

(12) United States Patent
Choi et al.

(10) Patent No.: US 6,834,170 B2
(45) Date of Patent: Dec. 21, 2004

(54) DEVELOPING APPARATUS HAVING SEALING MEMBER PREVENTING TONER LEAKAGE

(75) Inventors: Sam-seuk Choi, Gyeonggi-do (KR); Cheol-young Han, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 6 days.

(21) Appl. No.: 10/335,863

(22) Filed: Jan. 3, 2003

(65) Prior Publication Data

US 2003/0231904 A1 Dec. 18, 2003

(30) Foreign Application Priority Data

May 29, 2002 (KR) ..... 2002-29952

(51) Int. Cl.[7] ..... G03G 15/08
(52) U.S. Cl. ..... 399/103; 399/105
(58) Field of Search ..... 399/103, 105, 399/119

(56) References Cited

U.S. PATENT DOCUMENTS 6,459,867 B2 * 10/2002 Ohgoshi et al. ..... 399/103
2002/0090226 A1 * 7/2002 Sato et al. ..... 399/103
2002/0141778 A1 * 10/2002 Itabashi ..... 399/103

FOREIGN PATENT DOCUMENTS

JP 06308819 A * 11/1994 ..... G03G/15/08
JP 2000-181223 6/2000
JP 2000181223 A * 6/2000 ..... G03G/15/08

* cited by examiner

*Primary Examiner*—Susan Lee
(74) *Attorney, Agent, or Firm*—Staas & Halsey LLP

(57) ABSTRACT

A developing apparatus includes sealing members which are installed on both inside walls of a housing and closely contact the housing, a developer roller, and a blade to prevent the toner contained in the housing from leaking out. Each sealing member includes a first sealing member and a second sealing member. The first sealing member has a side part that elastically and closely contacts one inside wall of the housing and a short side part of the blade, and a front part that elastically and closely contacts the outer circumference of the developer roller. The second sealing member overlaps with the first sealing member and has a front part that elastically and closely contacts an inside surface of the blade and the outer circumference of the developer roller. Therefore, deterioration of a close contact of the sealing members due to compression and deformation of the sealing members may be prevented. Accordingly, a developing apparatus is configured to prevent leakage of toner.

18 Claims, 9 Drawing Sheets

DEVELOPING APPARATUS HAVING SEALING MEMBER PREVENTING TONER LEAKAGE

CROSS-REFERENCE TO RELATED APPLICATION

This application claims the benefit of Korean Application No. 2002-29952, filed May 29, 2002, in the Korean Intellectual Property Office, the disclosure of which is incorporated herein by reference.

BACKGROUND OF THE INVENTION

1. Field of the Invention

The present invention relates to a developing apparatus of a dry electrophotographic image forming apparatus, and more particularly, to a developing apparatus having a sealing member to prevent leakage of dry toner (hereinafter referred to as toner) contained in the developing apparatus.

2. Description of the Related Art

In general, a dry electrophotographic image forming apparatus contains toner and supplies the toner to a photoreceptor medium, such as a photoreceptor drum or the like, to develop a latent electrostatic image on the photoreceptor medium. Here, the toner is minute powder having a predetermined color and has to be contained in the developing apparatus except when being adhered to the latent electrostatic image. Therefore, the developing apparatus of the dry electrophotographic image forming apparatus using toner generally has a sealing member to prevent leakage of the toner.

FIG. 1 is an exploded perspective view of a conventional developing apparatus having sealing members. As shown in FIG. 1, the conventional developing apparatus includes a housing 100 which contains toner, and a blade 130 and a developer roller 120 which are respectively combined with the housing 100. The conventional developing apparatus also includes sealing members 140 which are disposed on insides 102 of right and left walls 104 of the housing 100 and closely contact the blade 130 and the developer roller 120 to prevent the toner in the housing 100 from leaking.

The developer roller 120 is coupled to couplings 101 which are prepared in the right and left walls 104 of the housing 100, to rotate. The developer roller adheres the toner in the housing 100 onto an outer circumference thereof, and supplies the toner to a photoreceptor drum (not shown) to develop a latent electrostatic image on the photoreceptor drum.

The blade 130 is conjoined with an upper surface 103 of the housing 100 in order to longitudinally contact the outer circumference of the developer roller 120. Thus, the blade 130 rubs against the outer circumference of the developer roller 120 that is rotating to scrape away the toner excessively adhered onto the outer circumference of the developer roller 120 so as to form a toner layer having a predetermined thickness.

Here, a length L2 of the developer roller 120 is smaller than an inner distance L1 between the right and left walls 104 of the housing 100, and a length L3 of the bladed 130 is smaller than the length L2 of the developer roller 120. Thus, the toner may leak through gaps between right and left ends 121 of the developer roller 120 and the insides 102 of the right and left walls 104 of the housing 100, and gaps between the blade 130 and the insides 102 of the right and left walls 104 of the housing 100. Therefore, in order to prevent leakage of the toner, the sealing members 140 are disposed on the insides 102 of the right and left walls 104 of the housing 100.

Since the sealing members 140 are generally formed of a sponge material, the sealing members 140 elastically and closely contact the outer circumference of the developer roller 120, the blade 130, and the insides 102 of the right and left walls 104 of the housing 100.

According to the above-described structure, when the sealing members 140, the blade 130, and the developer roller 120 are sequentially combined with the housing 100, the sealing members 140 closely contact the insides 102 of the right and left walls 104 of the housing 100, the outer circumference of the developer roller 120, and the blade 130. Thus, gaps between the right and left ends 121 of the developer roller 120 and the insides 102 of the right and left walls 104 of the housing 100, and gaps between the blade 130 and the insides 102 of the right and left walls 104 of the housing 100 are blocked to prevent leakage of the toner.

As described above, the length L2 of the developer roller 120 is smaller than the inner distance L1 between the right and left walls 104 of the housing 100, and the length L3 of the blade 130 is smaller than the length L2 of the developer roller 120. Thus, a contact width T2 between the blade 130 and the sealing member 140 is smaller than a width T1 of the sealing member 140.

FIG. 2A is a partial perspective view of the assembled conventional developing apparatus of FIG. 1, and FIG. 2 is an enlarged view of portion C of FIG. 2A. FIG. 3A is a cross-sectional view along cutting plane line A–A' of FIG. 2A, and FIG. 3B is an enlarged view of portion D of FIG. 3A.

As shown in FIGS. 2A, 2B, 3A, and 3B, lower portions of a front part 141 (shown in FIG. 1) of the sealing members 140 closely contact the outer circumference of the developer roller 120, and upper portions of the front part 141 of the sealing members 140 closely contact an inside surface 131 (shown in FIG. 1) of the blade 130 by the contact width T2.

A lower long side part 133 of the blade 130 has a bent portion 134, perpendicular to the long side part 133, in order to prevent the outer circumference of the developer roller 120 from being damaged due to contact with the blade 130. Since the bent portion 134 raises the sealing member 140, the sealing member 140 does not contact the outer circumference of the developer roller 120 at a portion in which the bent portion 134 is formed, thereby forming a gap 160. Reference character "a" of FIG. 2B represents a portion of the sealing member 140 which does not contact the blade 130, but is pulled and deformed in a direction 145 due to a portion of the sealing member 140 that contacts the blade 130 to be compressed, thereby forming a gap 150 between the sealing member 140 and the outer circumference of the developer roller 120. As a result of the above, the toner in the housing 100 may leak through gaps 160 and 150.

SUMMARY OF THE INVENTION

Accordingly, it is an aspect of the present invention to provide a developing apparatus having a sealing member which prevents deterioration of the sealing member due to compression and deformation of the sealing member.

Additional aspects and advantages of the invention will be set forth in part in the description which follows and, in part, will be obvious from the description, or may be learned by practice of the invention.

The foregoing and/or other aspects of the present invention are achieved by providing a developing apparatus including a housing, a developer roller, a blade, and sealing members. The housing contains toner. The developer roller is combined with the housing to rotate and adheres the toner onto an outer circumference thereof to supply the toner out of the housing. The blade controls an amount of toner that is adhered onto the outer circumference of the developer roller. The sealing members are installed on both inside walls of the housing and closely contact the housing, the developer roller, and the blade to prevent the toner from leaking out. The sealing members include a first sealing member and a second sealing member. The first sealing member has a side part that elastically and closely contacts the inside walls of the housing and a short side part of the blade, and a front part that elastically and closely contacts the outer circumference of the developer roller. The second sealing member overlaps with the first sealing member and has a front part that elastically and closely contacts an inside surface of the blade and the outer circumference of the developer roller.

According to an aspect of the invention, the second sealing member further includes a horizontal slit which is cut along a contact line with a lower long side part of the blade. The horizontal slit is cut at least to a depth in which the second sealing member is compressed when the blade is combined with the housing. The second sealing member overlaps with and is attached to the first sealing member.

According to an aspect of the invention, the developing apparatus includes the sealing member having a side part, a front part, and a vertical slit. The side part closely contacts the inside walls of the housing. The front part has an upper portion that partially overlaps with and elastically and closely contacts an inside surface of the blade, and a lower portion that elastically and closely contacts the outer circumference of the developer roller. The vertical slit is cut along a short side part of the blade at least up to a lower long side part of the blade.

According to an aspect of the invention, the sealing member further includes a horizontal slit which is cut along a contact line with the lower long side part of the blade to the short side part of the blade.

According to an aspect of the invention, the vertical slit is cut at least to a depth in which the sealing member is compressed when the blade is combined with the housing.

According to another aspect of the invention, the horizontal slit is cut at least to a depth in which the sealing member is compressed when the blade is combined with the housing.

BRIEF DESCRIPTION OF THE DRAWINGS

The above and/or other aspects and advantages of the invention will become apparent and more appreciated from the following description of the preferred embodiments, taken in conjunction with the accompanying drawings of which.

DETAILED DESCRIPTION OF THE INVENTION

Figure 1:
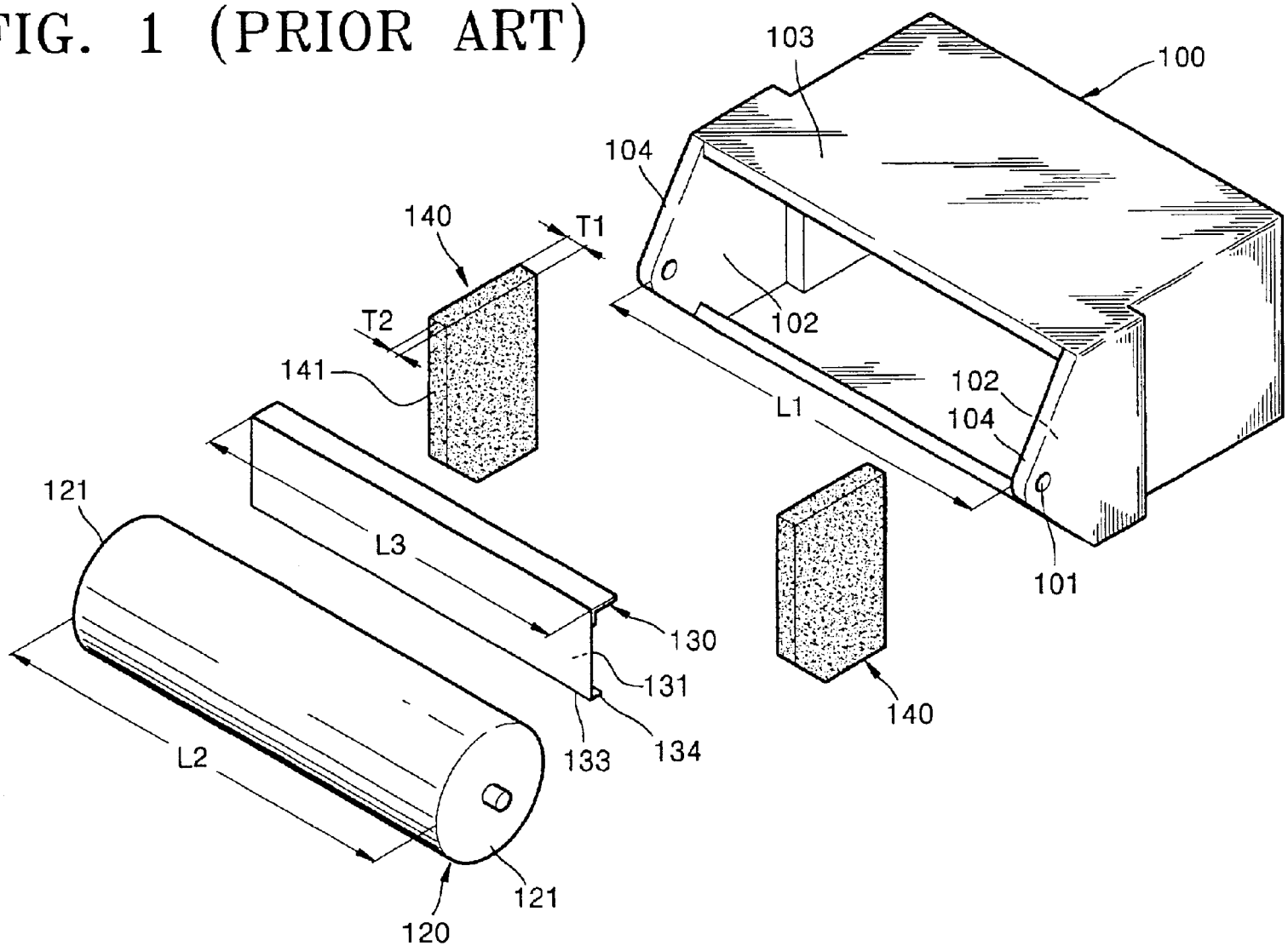
FIG. 1 (PRIOR ART)
FIG. 1 is an exploded perspective view of a conventional developing apparatus having sealing members.
Figure 2A:
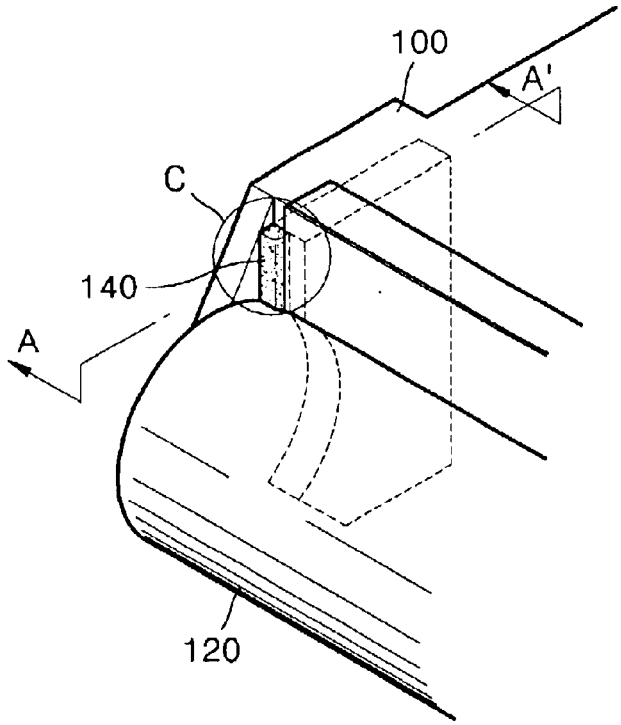
FIG. 2A (PRIOR ART)
FIG. 2A is a partial perspective view of the assembled conventional developing apparatus of FIG. 1.
Figure 2B:
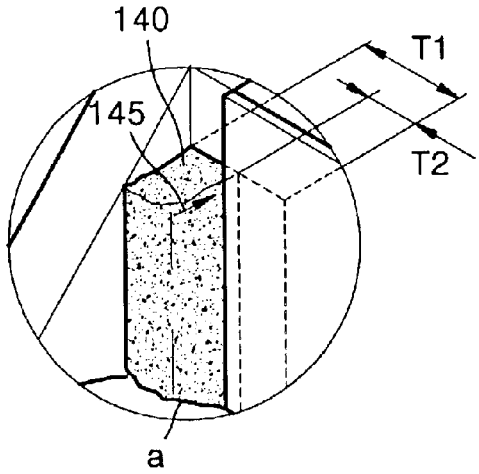
FIG. 2B (PRIOR ART)
FIG. 2B is an enlarged view of portion C of FIG. 2A.
Figure 3A:
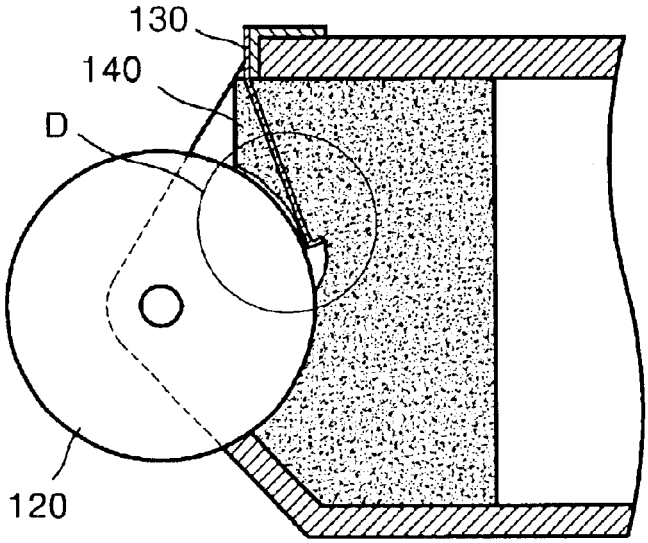
FIG. 3A (PRIOR ART)
FIG. 3A is a cross-sectional view along cutting plane line A–A' of FIG. 2A.
Figure 3B:
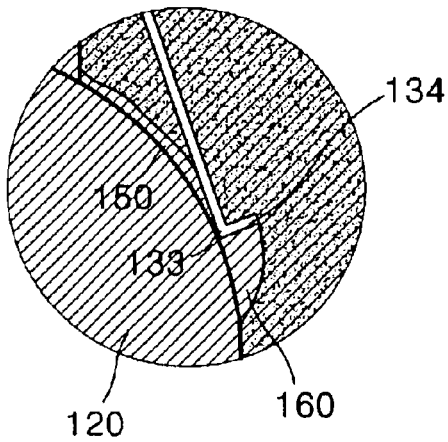
FIG. 3B (PRIOR ART)
FIG. 3B is an enlarged view of portion D of FIG. 3A.

Reference will now be made in detail to the present preferred embodiments of the present invention, examples of which are illustrated in the accompanying drawings, wherein like reference numerals refer to like elements throughout.

Figure 4:
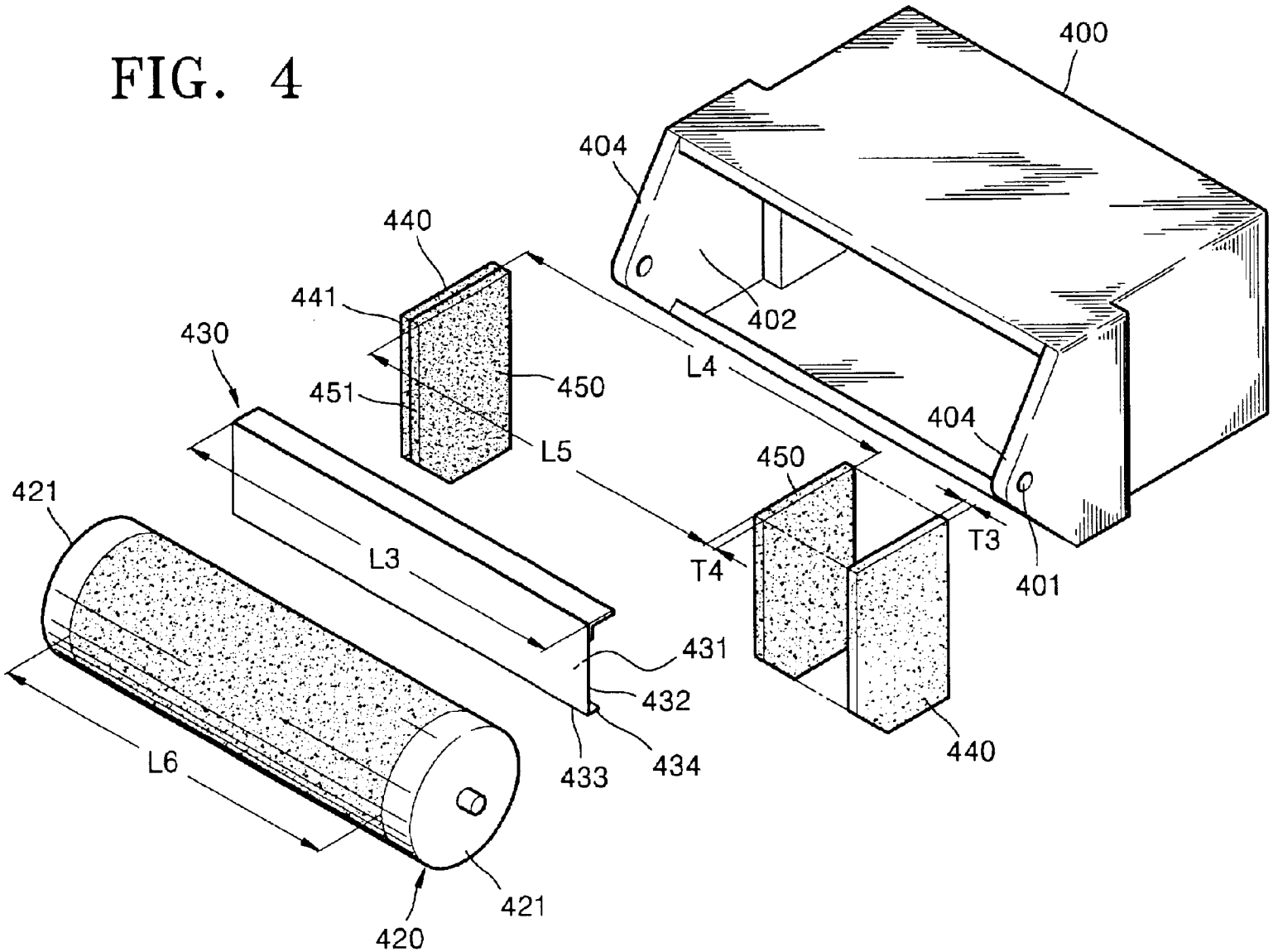
FIG. 4 is an exploded perspective view of a developing apparatus having sealing members, according to an embodiment of the present invention.

FIG. 4 is an exploded perspective view of a developing apparatus having sealing members, according to an embodiment of the present invention. As shown in FIG. 4, the developing apparatus includes a housing 400, a developer roller 420, a blade 430, and first and second sealing members 440 and 450.

First, the respective first and second sealing members 440 and 450 are overlapped and then are symmetrically combined with insides 402 of right and left walls 404 of the housing 400 that contain toner. Sides of the first sealing members 440 closely contact the insides 402 of the right and left walls 404 of the housing 400, respectively. Front parts 441 of the first sealing members 440 are elastically compressed and closely contact an outer circumference of the developer roller 420 when the developer roller 420 is combined with the housing 400. Front parts 451 of the second sealing members 450 are elastically compressed and closely contact the outer circumference of the developer roller 420 and an inside surface 431 of the blade 430 when the developer roller 420 and the blade 430 are combined with the housing 400.

A thickness T3 of the first sealing members 440 is predetermined so that an inner distance L4 between the first sealing members 440 that are disposed on right and left sides of the housing, is equal to or slightly smaller than a length L3 of the blade 430. A thickness T4 of the second sealing members 450 is predetermined so that an inner distance L5 between the second sealing members 450 that are disposed on right and left sides of the housing, is slightly greater than an effective image width L6. Here, the effective image width L6 represents a width of an image which is formed in an image forming apparatus (not shown).

The first and second sealing members 440 and 450 are preferably formed of an elastically deformable material (for example, a sponge).

Further, the blade 430 is combined with the housing 400. The blade 430, which scrapes away the toner excessively adhered onto the outer circumference of the developer roller 420 so as to form a toner layer having a predetermined thickness, applies a predetermined pressure to the outer circumference of the developer roller 420 to elastically and closely contact the outer circumference of the developer roller 420. Since the inner distance L4 between the first sealing members 440 is equal to or slightly smaller than the length L3 of the blade 430, right and left short side parts 432 of the blade 430 elastically and closely contact inner surfaces of the first sealing members 440.

The inner surface 431 of the blade 430 contacts the front parts 451 of the second sealing members 450 by the thickness T4 of the second sealing members 450. Here, when the second sealing members 450 are elastically compressed, the inner surface 431 of the blade 430 closely contacts the front parts 451 of the second sealing members 450.

The developer roller 420 is combined with couplings 401 which are disposed in the right and left sides of the housing 400. Here, the front parts 441 and 451 of the first and second sealing members 440 and 450 are elastically compressed and closely contact the outer circumference of the developer roller 420. Also, a lower long side part 433 of the blade 430 elastically contacts the outer circumference of the developer roller 420.

Figure 5A:
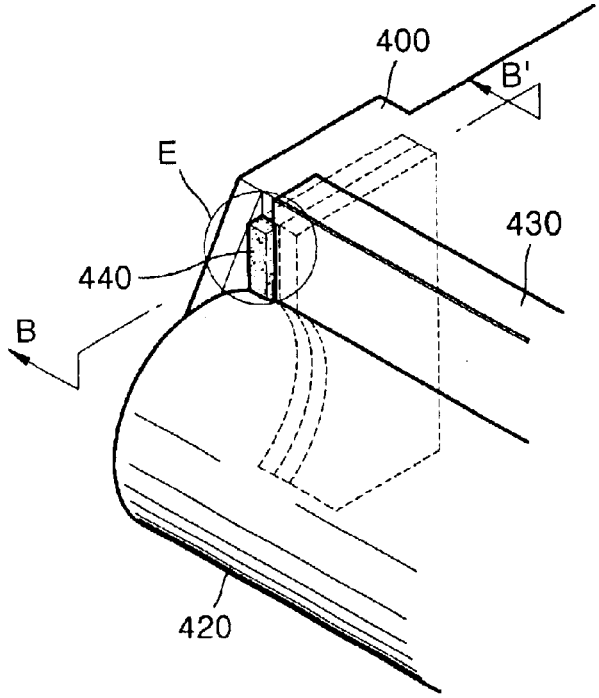
FIG. 5A is a partial perspective view of the assembled developing apparatus of FIG. 4.
Figure 5B:
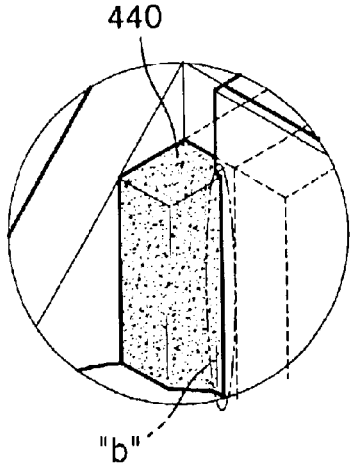
FIG. 5B is an enlarged view of portion E of FIG. 5A.
Figure 6A:
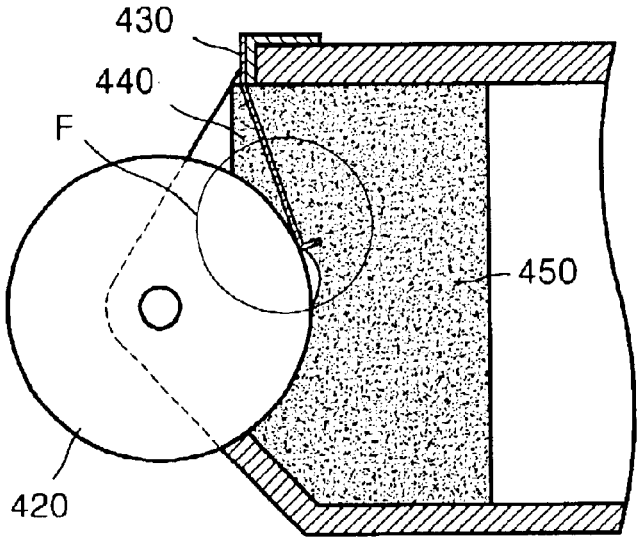
FIG. 6A is a cross-sectional view along cutting plane line B-B' of FIG. 5A.
Figure 6B:
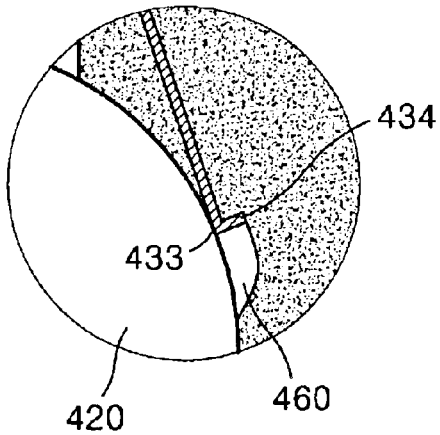
FIG. 6B is an enlarged view of portion F of FIG. 6A.

FIG. 5A is a partial perspective view of the assembled developing apparatus of FIG. 4, and FIG. 5B is an enlarged view of portion E of FIG. 5A. FIG. 6A is a cross-sectional view along cutting plane line B–B' of FIG. 5A, and FIG. 6B is an enlarged view of portion F of FIG. 6A.

Referring to FIGS. 5A, 5B, 6A, and 6B, a lower portion of the front part 441 (show in FIG. 4) of the first sealing member 440 is pushed and compressed by the outer circumference of the developer roller 420, to elastically and closely contact the outer circumference of the developer roller 420. Upper and lower portions of the front part 451 (shown in FIG. 4) of the second sealing member 450 are compressed by the blade 430 and the outer circumference of the developer roller 420, respectively, to elastically and closely contact the blade 430 and the outer circumference of the developer roller 420.

Here, the lower long side part 433 of the blade 430 has a bent portion 434 which does not allow the second sealing member 450 to closely contact the developer roller 420. As a result, a gap 460 may be formed between the second sealing member 450 and the developer roller 420.

However, the first sealing member 440 closely contacts the second sealing member 450, and as represented by reference character "b" of FIG. 5, the first sealing member 440 contacts the short side part 432 (shown in FIG. 4) of the blade 430. Thus, the toner does not leak out of the housing 400, except for toner which is supplied to a photoreceptor drum (not shown) via a contact portion between the outer circumference of the developer roller 420 and the blade 430.

Figure 7:
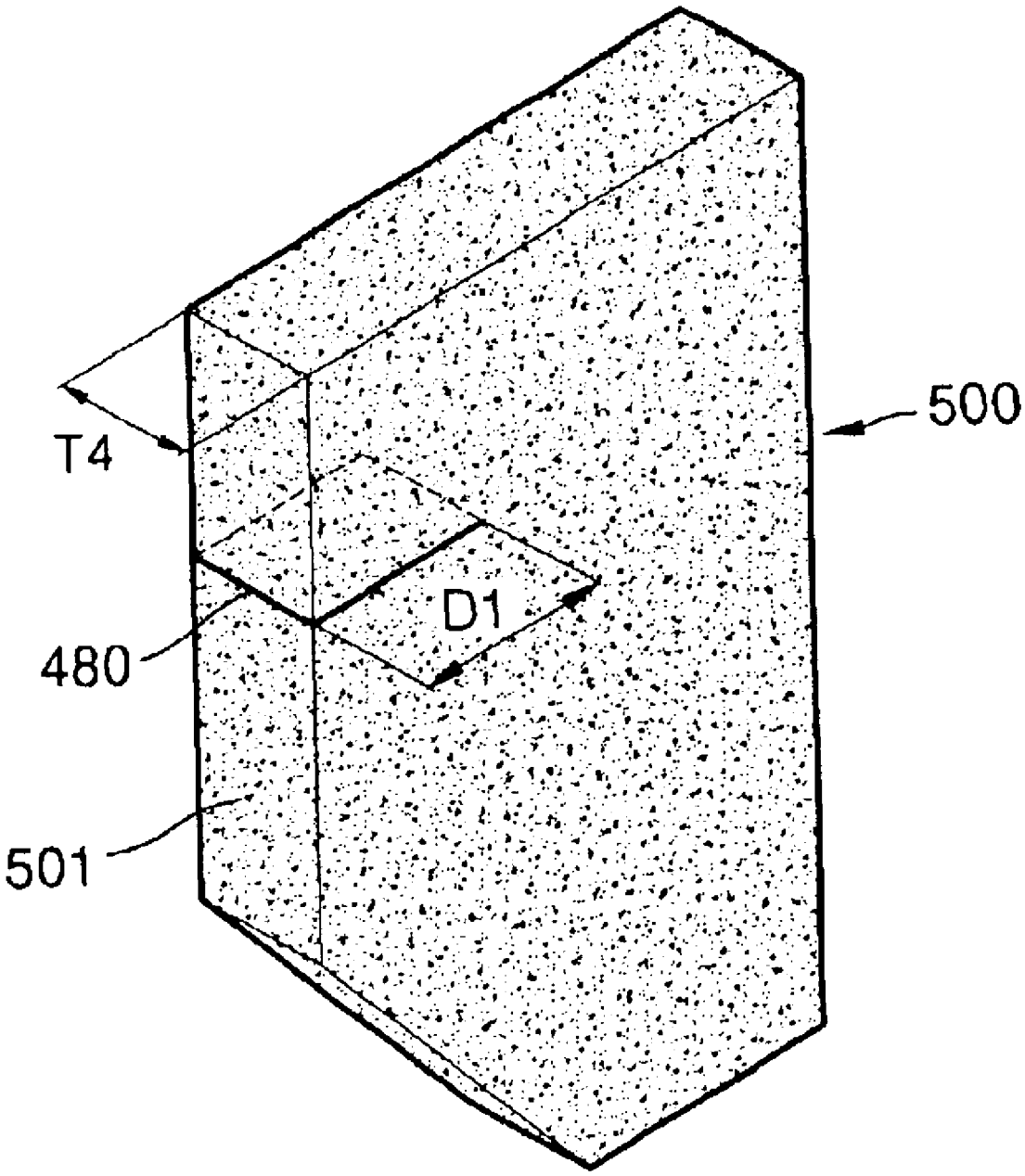
FIG. 7 is a perspective view of a sealing member, according to another embodiment of the present invention.
Figure 8A:
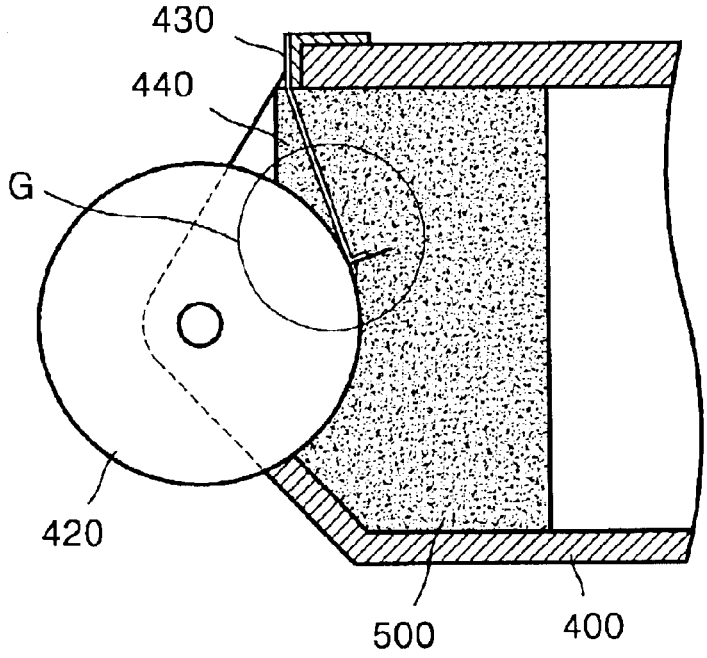
FIG. 8A is a cross-sectional view showing a sealed state of a developing apparatus, according to the present invention, using the sealing member shown in FIG. 7.
Figure 8B:
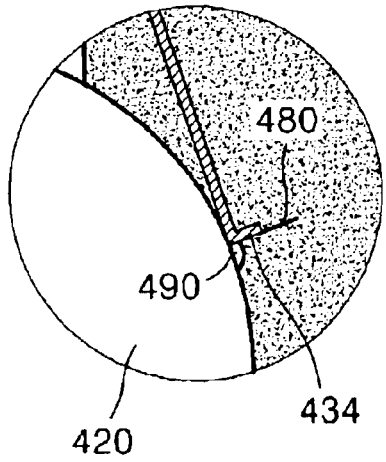
FIG. 8B is an enlarged view of portion G of FIG. 8A.

FIG. 7 is a perspective view of a sealing member, according to an embodiment of the present invention. FIG. 8A is a cross-sectional view showing a sealed state of a developing apparatus, according to the present invention, using the sealing member shown in FIG. 7. FIG. 8B is an enlarged view of portion G of FIG. 8A.

Referring to FIGS. 7, 8A, and 8B, a second sealing member 500 has a horizontal slit 480 cut along a contact line between the developer roller 420 and the lower long side part 433 of the blade 430.

In the above-described structure according to the embodiment as shown in FIG. 7, a front part 501 of the second sealing member 500 may be divided into upper and lower portions. Thus, since the bent portion 434 of the lower long side part 433 of the blade 430 is inserted into the horizontal slit 480, a gap 490, which is formed between the second sealing member 500 and the outer circumference of the developer roller 420, may be removed or minimized. The horizontal slit 480 is cut at least to a depth D1 in which the second sealing member 500 is compressed when the blade 430 is combined with the housing 400. Here, the first and second sealing members 440 and 500 may be attached to overlap each other, and then combined with the housing 400.

Figure 9:
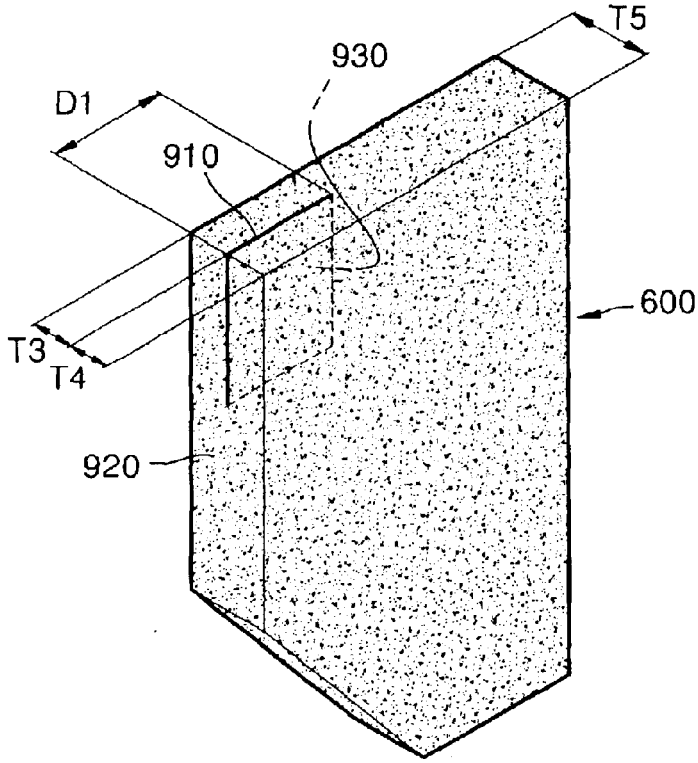
FIG. 9 is a perspective view of a sealing member, according to another embodiment of the present invention.

FIG. 9 is a perspective view of a sealing member, according to another embodiment of the present invention. Referring to FIG. 9, sealing members 600, which may perform the same functions as those of both the first and second sealing members 440 and 450, are symmetrically combined with the insides 402 of the right and left walls 404 of the housing 400 containing the toner. One side of the sealing members 600 closely contacts the inside 402 of the sidewall 404 of the housing 400. An upper portion of a front part 920 partially overlaps with and elastically and closely contacts the inside surface 431 of the blade 430. A lower portion of the front part 920 elastically and closely contacts the outer circumference of the developer roller 420. Also, the sealing member 600 has a vertical slit 910 cut along the short side part 432 of the blade 430 at least up to the lower long side part 433 of the blade 430.

Here, it is preferable that a thickness T5 of the sealing member 600 is equal to a value obtained by adding the thickness T3 of the first sealing member 440 (shown in FIG. 4) and the thickness T4 of the second sealing member 450 (shown in FIG. 4). Thus, the sealing member 600 and the blade 430 overlap each other by the thickness T4 of the second sealing member 450.

It is also preferable that the vertical slit 910 is cut at least to a depth D1 in which the front part 920 of the sealing member 600 is compressed when the blade 430 is combined with the housing 400.

In the above-described structure according to the embodiment as shown in FIG. 9, when the sealing member 600, the blade 430, and the developer roller 420 are combined with the housing 100, the sealing member 600 elastically and closely contacts the outer circumference of the developer roller 420 and the blade 430. Here, as described with reference to FIGS. 6A and 6B, due to the bent portion 434 of the long side part 433 of the blade 430, the sealing member 600 does not closely contact the developer roller 420 to thereby form a gap therebetween. However, since the sealing member 600 has the vertical slit 910, the short side part 432 of the blade 430 closely contacts a side 930 which is formed due to the vertical slit 910. As a result, the toner does not leak out of the housing 400. In other words, by forming the vertical slit 910 in the single sealing member 600, as described with reference to FIGS. 5A and 6A, the sealing member 600 produces the same effect as that of including the first and second sealing members 440 and 450.

Figure 10:
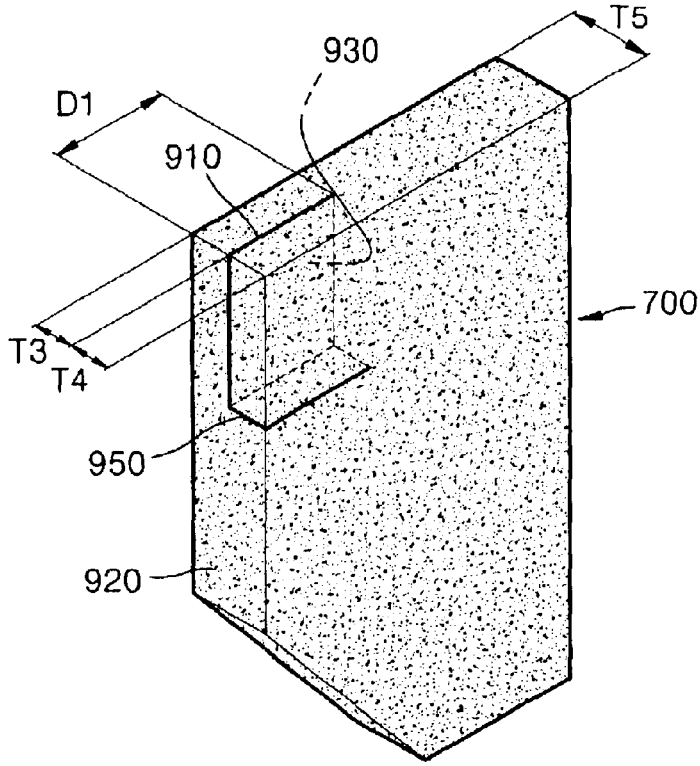
FIG. 10 is a perspective view of a sealing member, according to another embodiment of the present invention.

FIG. 10 is a perspective view of a sealing member, according to another embodiment of the present invention. As shown in FIG. 10, a sealing member 700 is the same as the sealing member 600 shown in FIG. 9 except that it further has a horizontal slit 950 which is cut along the contact line with the lower long side part 433 of the blade 430 up to the short side part 432 of the blade 430. It is preferable that the horizontal slit 950 is cut at least to the same depth D1 as the vertical slit 910. Accordingly, the single sealing member 700 produces the same effect as described with reference to FIGS. 8A and 8B.

As described above, in a developing apparatus according to the present invention, a close contact property among a sealing member, a developer roller, and a blade may be improved in order to minimize a gap formed around a contact line between the blade and the developer roller, and to prevent toner from leaking through the gap.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A developing apparatus, comprising:

a housing which contains toner;

a developer roller which is combined with the housing to rotate and adheres toner onto an outer circumference thereof, to supply toner out of the housing;

a blade which controls an amount of toner that is adhered onto the outer circumference of the developer roller; and sealing members which are installed on both inside walls of the housing and closely contact the housing, the developer roller, and the blade to prevent the toner from leaking out, wherein the sealing members comprise:

a first sealing member which has a side part that elastically and closely contacts the inside walls of the housing and a short side part of the blade, and a front part that elastically and closely contacts the outer circumference of the developer roller; and a second sealing member which overlaps with the first sealing member and has a front part that elastically and closely contacts an inside surface of the blade and the outer circumference of the developer roller.

2. The developing apparatus of claim 1, wherein the second sealing member further comprises:

a horizontal slit which is cut along a contact line with a lower long side part of the blade.

3. The developing apparatus of claim 2, wherein the horizontal slit is cut at least to a depth in which the second sealing member is compressed when the blade is combined with the housing.

4. The developing apparatus of claim 2, wherein the second sealing member overlaps with and is attached to the first sealing member.

5. The developing apparatus of claim 1, wherein a thickness of the first sealing member is predetermined so that an inner distance between the first sealing member disposed on the inside walls of the housing is equal to or slightly smaller than a length of the blade.

6. The developing apparatus of claim 1, wherein a thickness of the second sealing member is predetermined so that an inner distance between the second sealing member disposed on the inside walls of the housing is slightly greater than an image width to be formed by the developer roller.

7. The developing apparatus of claim 1, wherein the first and second sealing members are formed of an elastically deformable material.

8. A developing apparatus, comprising:

a housing which contains toner;

a developer roller which is combined with the housing to rotate and adheres toner onto an outer circumference thereof, to supply toner out of the housing;

a blade which controls an amount of the toner that is adhered onto the outer circumference of the developer roller; and a sealing member which is installed on both inside walls of the housing and closely contacts the housing, the developer roller, and the blade to prevent the toner from leaking out, wherein the sealing member comprises:

a side part which closely contacts the inside walls of the housing;

a front part which has an upper portion that partially overlaps with and elastically and closely contacts an inside surface of the blade, and a lower portion that elastically and closely contacts the outer circumference of the developer roller; and a vertical slit which is cut along a short side part of the blade at least up to a lower long side part of the blade.

9. The developing apparatus of claim 8, wherein the vertical slit is cut at least to a depth in which the sealing member is compressed when the blade is combined with the housing.

10. The developing apparatus of claim 8, wherein the sealing member further comprises:

a horizontal slit which is cut along a contact line with the lower long side part of the blade to the short side part of the blade.

11. The developing apparatus of claim 10, wherein the horizontal slit is cut at least to a depth in which the sealing member is compressed when the blade is combined with the housing.

12. The developing apparatus of claim 11, wherein the horizontal slit and the vertical slit are perpendicular to each other.

13. The developing apparatus of claim 11, wherein the horizontal slit is cut to at least a depth the same as the depth of the vertical slit.

14. A developing apparatus having a housing which contains toner, a developer roller combined with the housing to rotate and adhere toner onto an outer circumference thereof, and a blade to control an amount of adhered toner, the developing apparatus comprising:

first and second sealing members which are installed on both inside walls of the housing and closely contact the housing, the developer roller, and the blade to prevent the toner from leaking out, wherein the first sealing members each include a side part that elastically and closely contacts the inside walls of the housing and a short side part of the blade, and a front part that elastically and closely contacts the outer circumference of the developer roller, and the second sealing members overlap with the respective first sealing members, each including a front part that elastically and closely contacts an inside surface of the blade and the outer circumference of the developer roller, and including a slit which is cut along a contact line with a long side part of the blade.

15. A developing apparatus having a housing which contains toner, a developer roller combined with the housing to rotate and adhere toner onto an outer circumference thereof, and a blade to control an amount of adhered toner, the developing apparatus comprising:

a sealing member which is installed on both inside walls of the housing and closely contact the housing, the developer roller, and the blade to prevent the toner from leaking out, the sealing member including, a side part which closely contacts the inside walls of the housing, a front part which has a portion that partially overlaps with and elastically and closely contacts an inside surface of the blade, and a portion that elastically and closely contacts the outer circumference of the developer roller, and a slit which is cut along a short side part of the blade at least up to a long side part of the blade.

16. A developing apparatus having a housing which contains toner, a developer roller combined with the housing to rotate and adhere toner onto an outer circumference thereof, and a blade to control an amount of adhered toner, the developing apparatus comprising:

a sealing member which is installed on both inside walls of the housing and closely contact the housing, the developer roller, and the blade to prevent the toner from leaking out, the sealing member including, a side part which closely contacts the inside walls of the housing, a front part which has a portion that partially overlaps with and elastically and closely contacts an inside surface of the blade, and a portion that elastically and closely contacts the outer circumference of the developer roller, a first slit which is cut along a short side part of the blade at least up to a long side part of the blade, and a second slit which is cut along a contact line with the long side part of the blade to the short side part of the blade.

17. The developing apparatus of claim 16, wherein the first slit and the second slit are perpendicular to each other.

18. The developing apparatus of claim 16, wherein the first slit is cut to at least a depth the same as the depth of the second slit.

* * * * *